United States Patent [19]

Itoh et al.

[11] Patent Number: 5,065,187

[45] Date of Patent: Nov. 12, 1991

[54] IMAGE FORMING SYSTEM

[75] Inventors: Shinichi Itoh; Hiroaki Sato; Masayuki Taniguchi, all of Tokyo, Japan

[73] Assignee: Oki Electric Industry Co., Ltd., Tokyo, Japan

[21] Appl. No.: 597,044

[22] Filed: Oct. 15, 1990

[30] Foreign Application Priority Data

Oct. 19, 1989 [JP] Japan ..... 1-270204
Jul. 31, 1990 [JP] Japan ..... 2-201175

[51] Int. Cl.[5] ..... G03G 21/00
[52] U.S. Cl. ..... 355/215; 355/219
[58] Field of Search ..... 355/215, 273, 200, 245, 355/260, 221, 222, 271; 250/324, 325, 326

[56] References Cited

U.S. PATENT DOCUMENTS

| | | | |
|---|---|---|---|
| 3,722,992 | 3/1973 | Zweig | 355/210 |
| 3,751,157 | 8/1973 | Johnson | 355/243 |
| 3,778,841 | 12/1973 | Gundlach et al. | 355/212 X |
| 3,924,945 | 12/1975 | Weigl | 355/258 |
| 3,937,572 | 2/1976 | Gaynor et al. | 355/217 |
| 3,950,680 | 4/1976 | Michaels et al. | 355/219 |
| 4,734,359 | 3/1988 | Oguchi et al. | 430/945 |
| 4,760,410 | 7/1988 | Kishi | 346/153.1 |
| 4,853,736 | 8/1989 | Goto et al. | 355/219 |

FOREIGN PATENT DOCUMENTS

| | | | |
|---|---|---|---|
| 0073168 | 4/1986 | Japan | 355/215 |
| 0084658 | 4/1986 | Japan | 355/215 |
| 0191174 | 8/1989 | Japan | 355/219 |

*Primary Examiner*—A. T. Grimley
*Assistant Examiner*—Christopher Horgan
*Attorney, Agent, or Firm*—Spencer & Frank

[57] ABSTRACT

In an image forming system employing a photosensitive drum on which an electrostatic latent image is formed, and a toner image bearing belt on which a toner image corresponding to the electrostatic latent image is formed by means of a developing device, a discharging device, such as an AC corona discharger, is provied to face the toner image bearing belt superimposed on the photosensitive drum, at a location downstream of the developing area. The surface charges on the toner image bearing member are therefore removed before or when the toner image bearing member separates from the photosensitive drum. As a result, the increase of the potential difference across the air layer due to the decrease of the capacitance of the air layer between the toner image bearing member and the photosensitive drum is prevented, and electrical discharge through the air layer, and attendant scattering of the toner image are thereby avoided.

11 Claims, 13 Drawing Sheets

IMAGE FORMING SYSTEM

FIELD OF THE INVENTION

This invention concerns an image forming system used in recording devices such as printers and copiers, and in display devices.

BACKGROUND OF THE INVENTION

Conventionally, images in recording devices such as printers and copiers were generally formed by Carlson's electrophotography.

Electrophotography of the Carlson's system has been widely employed for forming images in photocopying and printing. Electrophotography uses a drum having a photosensitive surface which passes a charging section where the photosensitive surface is uniformly charged, an exposure section where the photosensitive surface is exposed to a light image or a pattern of light which corresponds to the original (source document) or the print data to form an electrostatic latent image consisting of charged areas and discharged areas, a developing section where toner is attracted to the charged areas of the latent image so that a toner image is created, a transfer section where the toner image is transferred to a recording paper which is brought into contact with the photosensitive drum, and a cleaning section which removes any residual toner on the photosensitive surface. The toner image that has been transferred to the recording paper is fixed by application of heat, for example, and the recording paper is then discharged from the apparatus.

A problem associated with the prior system is that because various devices must be disposed on the periphery of the photosensitive drum, the drum must have a sufficient diameter, and the cost of the drum is high, and the overall apparatus is bulky.

Another problem is that there is a considerable amount of toner remaining on the photosensitive drum after the transfer of the toner image. This residual toner must be removed by a cleaning device, and must be collected and then disposed. When the collected toner is disposed, the toner may be scattered in and out of the apparatus, and the operator's clothing or body may be soiled.

To overcome these drawbacks, an image forming system has been proposed in which a toner image bearing belt is passed around a photosensitive drum and through a transfer section, a developing device is provided facing the toner image bearing belt passing over the photosensitive drum on which an electrostatic latent image has been formed, for causing toner to be attracted toward the photosensitive drum, and thereby forming a toner image on the toner image bearing belt which is passes around the photosensitive drum, and the toner image on the toner image bearing belt is transferred to a recording paper that is brought into contact with the toner image bearing belt at the transfer section.

In the system described above, when the toner image on toner image bearing belt was transferred to and fixed on the recording paper, some disturbances were found to occur in the image reproduced on the recording paper. Upon examination, it has been found that the toner on the toner image bearing belt scattered when the toner image bearing belt separated from the photosensitive drum.

OBJECTS OF THE INVENTION

An object of the invention is to reduce the scattering of toner which takes place when the toner image bearing belt with the toner image formed thereon separates from the photosensitive drum.

SUMMARY OF THE INVENTION

In the image forming system of this invention, a discharge means, for example an AC corona discharger, is provided to remove the surface charges from the toner image bearing belt superimposed on the photosensitive drum or some other electrostatic latent image bearing member, at a location downstream of the location where the developing means is provided. By virtue of this discharging means, the rise of an electric potential difference across the air layer due to the decrease of capacitance which occurred in the prior art system when the toner image bearing belt separates from the photosensitive drum or the like, and the resulting electric discharge in the air layer are prevented.

DETAILED DESCRIPTION OF THE PREFERRED EMBODIMENTS

Embodiments of the invention will now be described with reference to the drawings.

EMBODIMENT 1

An embodiment of this invention will now be described with reference to FIGS. 1 through 4B.

Figure 1:
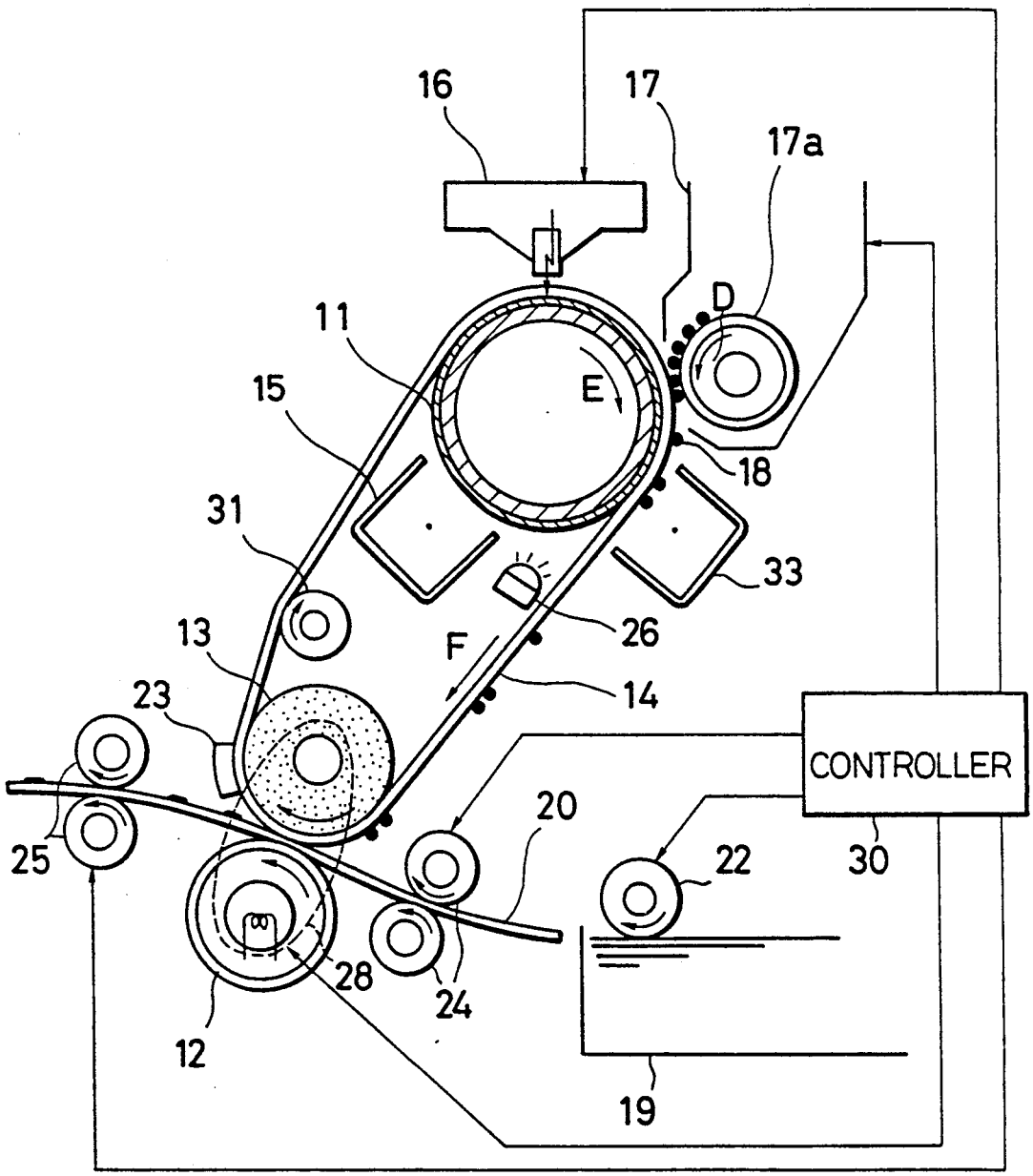
FIG. 1 is a schematic diagram of the image forming system of an embodiment (Embodiment 1) of the invention.

FIG. 1 is a schematic diagram of the image forming system of Embodiment 1, which is an electrophotography apparatus.

The illustrated electrophotography apparatus comprises a photosensitive member in the form of a photosensitive drum 11 rotatably mounted on a frame, not shown. The photosensitive drum is rotated at a constant speed by a motor, not shown. The photosensitive drum 11 has a photosensitive layer 11*b* on an electrically conducting support 11*a*. Suitable materials for the photosensitive layer are selenium photosensitive material, an organic photosensitive material, a zinc oxide photosensitive material and an amorphous silicon photosensitive material. In this embodiment, a composite layer structure of an organic photosensitive material of the positive type comprising a charge transport layer and a charge generating layer formed in that order are employed.

The image forming apparatus also comprises a heating roller 12 and a pressure roller 13 which are pressed against each other by a means not shown. The heating roller 12 may be of a hollow metal member enclosing a halogen lamp, or one having a heat-emitting body on a metal surface.

An endless toner image bearing belt 14 is passed around the photosensitive drum 11 and the pressure roller 13. More particularly, the toner image bearing belt 14 is in contact, on a first or inner surface thereof, with the peripheral surface of the photosensitive drum 11 over a portion of the photosensitive drum arc, and as the photosensitive drum 11 rotates, the toner image bearing belt 14 moves together with the photosensitive drum 11. Where the toner image bearing belt 14 passes around the pressure roller 13, it passes between the heating roller 12 and the pressure roller 13. The location where the heating roller 12 confronts the pressure roller 13 forms a transfer and fixing section 28.

As the photosensitive drum 11 rotates, its surface sequentially passes various processing sections or devices, namely an electrifying or charging device 15, an exposure device 16, a developing device 17, a discharging device 33, and a discharge lamp 26. The exposure device 16, the developing device 17 and the discharging device 33 are provided to face the toner image bearing belt 14 superimposed on the photosensitive drum 11. Between the location where the charging device 15 confronts the photosensitive drum 11 and the location where the exposing device 16 confronts the toner image bearing belt 14, the toner image bearing belt 14 is brought into contact with the photosensitive drum 11. Between the location where the developing device 17 confronts the toner image bearing belt 14 and the location where the discharging lamp 26 confronts the photosensitive drum 11, the toner image bearing belt 14 is separated from the photosensitive drum 11. The discharging device 33 is disposed at or downstream of (with respect to the direction of the movement of the toner image bearing belt 14) the location where the developing device 17 confronts the toner image bearing belt 14. In the embodiment illustrated, it is disposed at the location where the toner image bearing belt 14 separates from the photosensitive drum 11.

The charging device 15 is a corona discharge device for providing an electrostatic charge uniformly over the photosensitive surface of the photosensitive drum 11. The charging device 15 may alternatively be formed of a brush discharge device, or any other type of charging means.

The exposure device 16 exposes the photosensitive drum 11 through the toner image bearing belt to a light image or radiation pattern to form an electrostatic latent image on the photosensitive surface of the photosensitive drum 11. The areas or dots of the photosensitive surface which have been irradiated by light is discharged, while the areas or dots of the photosensitive drum which have not been irradiated are kept charged. This does not mean that each area can assume either of the two distinct states: charged and discharged. That is, there can be intermediate states and each area is discharged to the degree which is dependent on the density of the corresponding area of the image. However, the following description will be made assuming that the latent image consists of charged areas and discharged areas, for simplicity of explanation and illustration.

The toner image bearing belt 14 must be transparent to the wavelengths of the light used for the exposure. The exposure device 16 may be a combination of an LED array and a Selfoc lens (commercial name), or a combination of a laser and an optical imaging system. In these cases, the light image is produced by electrical signals representing the image. Such electrical signals are supplied from a controller 30 which also performs the overall control of the apparatus. The exposure device 16 may alternatively be a combination of an illuminating device illuminating an original document and an optical imaging system for directing the light reflected at the surface of the original to the photosensitive surface of the photosensitive drum 11.

The developing device 17 is installed facing the outer surface of the toner image bearing belt 14 which is moving in contact with the photosensitive drum 11, as described above. The developing device 17 is provided with a toner support 17*a*, to which toner 18 is attached. The toner 18 is transported so as to develop the electrostatic latent image to form a corresponding toner image on the outer surface of the toner image bearing belt 14. The developing device may be a two-component magnetic brush developer, a one-component magnetic brush developer, or a one-component non-magnetic developer.

The discharging device 33 removes the surface charges from the toner image bearing belt 14. In this embodiment, an AC corona discharger is employed.

The discharge lamp 26 is provided to face the part of the photosensitive drum 11 which has just separated from the toner image bearing belt 14 after developing. The function of the discharge lamp 26 is to irradiate the photosensitive drum 11 through its entire width to dissipate all the charges on it thereby making it ready for next cycle of operation.

As described earlier, the toner image bearing belt 14 passes around the photosensitive drum 11, and through the transfer and fixing section 28 which is formed at the location where the pressure roller 13 and the heating roller 12 are juxtaposed. The toner image bearing belt 14 also passes a cleaning device 23.

The cleaning device 23 is provided in opposition to the pressure roller 13, but after the transfer and fixing section. The function of the cleaning device 23 is to remove any residual toner from the toner image bearing belt 14 after transfer of the toner image to a recording paper 20.

The paper feed system for the recording paper 20 is comprised of a paper feed cassette 19, a paper pick-up roller 22, a paper advance roller 24, and a paper eject roller 25. Their operation is controlled by the controller 30.

The photosensitive drum 11 and the heating roller 12 are rotated at a constant peripheral speed in the direction shown by the arrow E by a drive mechanism, not shown. Moreover, a suitable tension is applied via the tension roller 31 to the toner image bearing belt 14. As a result, due to the frictional force of the photosensitive drum 11 and the pressure roller 12, the toner image bearing belt 14 is moved in the direction shown by the arrow F.

The image forming process will now be described with reference to FIGS. 2A to 2D.

Figure 2A:
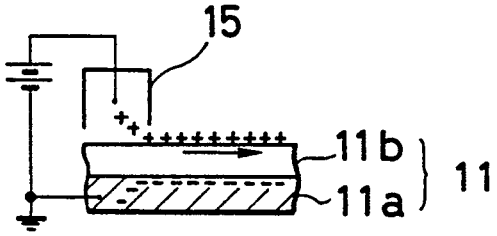
FIG. 2A to FIG. 2D show various process steps of the operation of the image forming system of Embodiment 1.
Figure 2B:
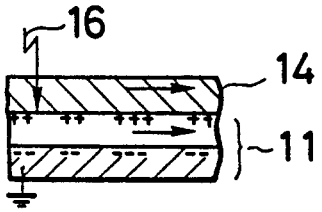
Figure 2C:
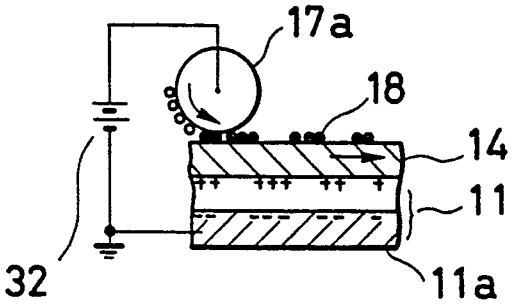
Figure 2D:
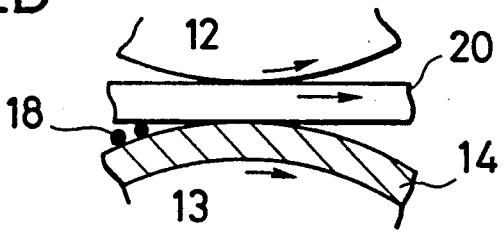

FIG. 2A shows the charging process, FIG. 2B shows the exposure process, FIG. 2C shows the development process, and FIG. 2D shows the transfer and fixing process.

In the charging step shown in FIG. 2A, the surface of the photosensitive drum 11 is directly charged uniformly by the corona charger 15. In the illustrated example, the photosensitive drum 11 is formed of a photosensitive layer 11*a* coated on an electrically conductive support 11*b*, and a positively charged photosensitive material is used. When a high voltage is applied to the corona charger 15, the surface of the photosensitive layer 11*a* is charged positively.

In the exposure process (FIG. 2B), light from the exposure device 16 passes through the toner image bearing belt 14 and is irradiated onto the photosensitive drum 11 to form an electrostatic latent image on the photosensitive layer 11*a* of the photosensitive drum 11. The latent image consists of charged areas which have not been irradiated, and discharged areas which have been irradiated.

In the developing step shown in FIG. 2C, reversal development is used, and a power supply 32 for applying a bias potential is connected across the electrically conducting support 11*b* of photosensitive drum 11 and the toner support 17*a*. As a result, the discharged areas of the latent image on the photosensitive drum 11 attract the positively charged toner 18, and the attracted toner 18 is attached to the outer surface of the toner image bearing belt 14 directly over the discharged areas. More specifically, electric lines of force are generated between the toner support 17*a* and the discharged areas of the latent image on the photosensitive drum 11, passing through the toner image bearing belt 14. The particles of the toner 18 travel along these electric lines of force and adhere to the outer surface of the toner image bearing belt 14, and are kept adhered thereto by a relatively weak electrostatic force.

After the development, the toner image bearing belt 14 separates from the photosensitive drum 11. When the toner image bearing belt 14 separates, the discharging device 33 discharges the surfaces charges from the toner image bearing belt 14. The toner image bearing belt 14 is thereafter moved past the transfer and fixing section 28 where the transfer and fixing step shown in FIG. 2D takes place. In synchronism with the toner image on the toner image bearing belt 14, the recording paper 20 is fed to the transfer and fixing section 28. More specifically, the recording paper is the supplied from the paper supply cassette 19, being picked up by the pick-up roller 22, and is brought to the paper advance roller 24 which is stationary. Here, any skew of the paper is corrected, and the paper advance roller 24 is then driven to advance the recording paper. The paper feeding is made so that the leading edge of the area of the recording paper in which the image is to be reproduced arrives at the transfer and fixing section 28 simultaneously with and hence comes into contact with the leading edge of the area of the toner image bearing belt 14 in which the toner image is formed. The toner image bearing belt 14 and the recording paper 20 are moved at the same speed.

The recording paper 20 and the toner image bearing belt 14 are held between the pressure roller 13 and the heating roller 12. The toner image on the toner image bearing belt 14 is therefore melted by the heat of the heating roller 13, whereupon the pressure causes melted toner 18 to permeate the fibers of the recording paper 20. This transfers and fixes the toner image so as to reproduce an image on the recording paper 20.

The recording paper 20 is thereafter discharged or ejected by means of the eject roller 25, out of the housing of the apparatus, onto a stacker, not shown, for example.

After the transfer of the toner image onto the recording paper 20 is completed, a small amount of toner 18 may remain on the toner image bearing belt 14. This however is wiped off by bringing the cleaning device 23 into pressure-contact with the toner image bearing belt 14 on the pressure roller 13. At that time, the residual toner 18 is still molten, and it is therefore easily removed. In this way, the toner image bearing belt 14 is cleaned.

After separation from the toner image bearing belt 14, the photosensitive drum 11 is irradiated by the discharge lamp 26 so as to dissipate any residual electrostatic charge on the photosensitive drum 11. The photosensitive drum 11 then returns to the charging section, and may thus be used again.

The feature of this embodiment is the provision of the discharging device 33, such as an AC corona discharger, to face the toner image bearing belt 14 passing over the photosensitive drum 11, downstream of the location where the developing device 17 is disposed.

The discharging device 33 removes the surface charges from the toner image bearing belt 14. This suppresses the rise of an electric potential difference across the air layer due to the decrease in capacitance of the air layer at the location where the toner image bearing belt 14 separates from the photosensitive drum 11. As a result, discharge through the air layer is prevented, as is the disturbance of the toner image on the toner image bearing belt which occurred in the prior art.

The use of this AC corona discharger 33 has been found most effective when it is disposed at the location where the toner image bearing belt 14 separates from the photosensitive drum 11.

The operation of the discharging device 33 will be described in further detail with reference to FIG. 3, FIG. 4A and FIG. 4A, which show the actions which take place when the toner image bearing belt 14 carrying the toner image and the photosensitive drum 11 are separating.

Figure 3:
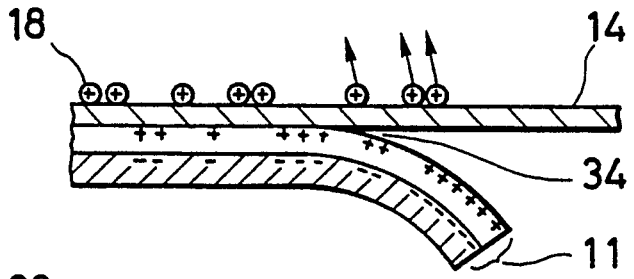
FIG. 3, FIG. 4A and FIG. 4B show the actions which take place when the toner image bearing belt carrying the toner image and the photosensitive drum are separating.

FIG. 3 shows the action which takes place if the discharging device 33 is not provided. FIG. 4A and FIG. 4B show the actions which take place if the discharging device 33 is provided according to the invention.

If the discharging device is not provided, as shown in FIG. 3, toner 18 on the toner image bearing belt 14 is scattered when the toner image bearing belt 14 separates from the photosensitive drum 11. This is due to the fact that the capacitance of the air layer 34 between the toner image bearing belt 14 and the photosensitive drum 11 is decreasing at this point, leading to a rise of electric potential and a discharge in the air layer 34.

Figure 4A:
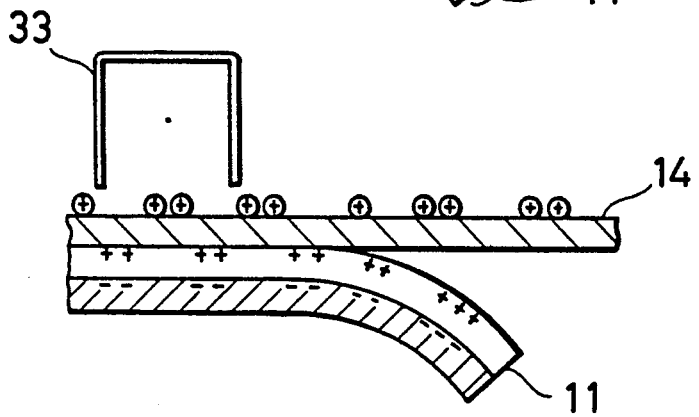
Figure 4B:
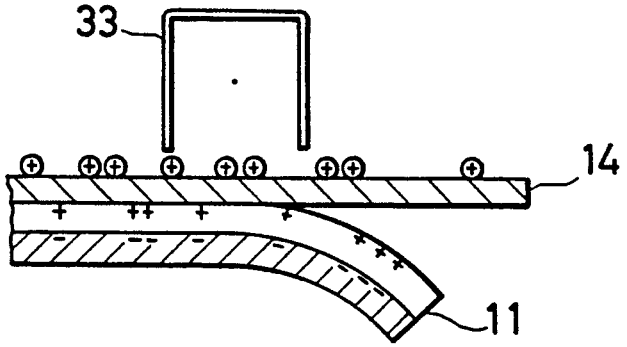

To prevent this, in FIG. 4A, a corona discharger 33 is installed above toner image bearing belt 14 upstream of the location where the toner image bearing belt 14 and the photosensitive drum 11 are separating.

When the toner image bearing belt 14 and the photosensitive drum 14 are separating, the charges on its surface are removed by the corona discharger 33. The rise of potential difference across the air layer which accompanies the decrease of capacitance of the air layer 34 between the toner image bearing belt 14 and the photosensitive drum 11 when they are separating is thus suppressed, and discharge through the air layer 34 is prevented. As a result, disturbance of the toner image on the toner image bearing belt 14 at the time of separation is reduced.

In FIG. 4B, the corona discharger 33 extends from a location where the toner image bearing belt 14 and the photosensitive drum 11 are in contact up to a location where they separate. In this case, the scattering of the toner image on the toner image bearing belt 14 is further reduced.

In FIG. 4A and FIG. 4B, the disturbance of the toner image is most reduced if the voltage applied to the corona charger is AC (alternating current). Use of a DC (direct current) voltage with the polarity identical to the photosensitive drum 11 gives the next best result. A DC voltage with the opposite polarity is less effective.

In the above-described transfer and fixing process, the toner image bearing belt 14 is heated by the heating roller 12 to reach a temperature of about 160° C. It must therefore be heat resistant, and must also have insulating properties to a certain extent, and transparency to the wavelengths of the light emitted in the exposure process. From these considerations, the toner image bearing belt 14 used may consist of a film formed of a material such as polyester, polyimide, polyetherimide, polyethersulfone or polyetheretherketone.

Further, from consideration of the electric lines of force generated in the developing process, it is desirable that the thickness of the toner image bearing belt 14 be no greater than 100 μm; while from considerations of tensile strength and ease of handling, it is desirable that its thickness be not less than 5 μm.

In the above embodiment, the toner 18 is a heat fixing toner, but a pressure fixing toner may be used instead. An example of pressure fixing toner is a microcapsule pressure fixing toner, which can be fixed with minute pressure. In this case, the heating roller 12 may be omitted.

In the above embodiment, the photosensitive drum 11 is exposed through the toner image bearing belt 14 to form the electrostatic latent image. The toner image bearing belt 14 must therefore be transparent to the wavelength of the light source used in the exposure device.

As an alternative, the photosensitive drum 11 may be exposed directly, i.e., without interposition of the toner image bearing belt 14, and the toner image bearing belt 14 may be brought into contact with the photosensitive drum 11 between the exposure section and the development section. In this case, the toner image bearing belt 14 need not have a transparency to the wavelengths of the light emitted from the exposure device 16.

EMBODIMENT 2

A second embodiment (Embodiment 2) of the invention will now be described with reference to FIG. 5.

Figure 5:
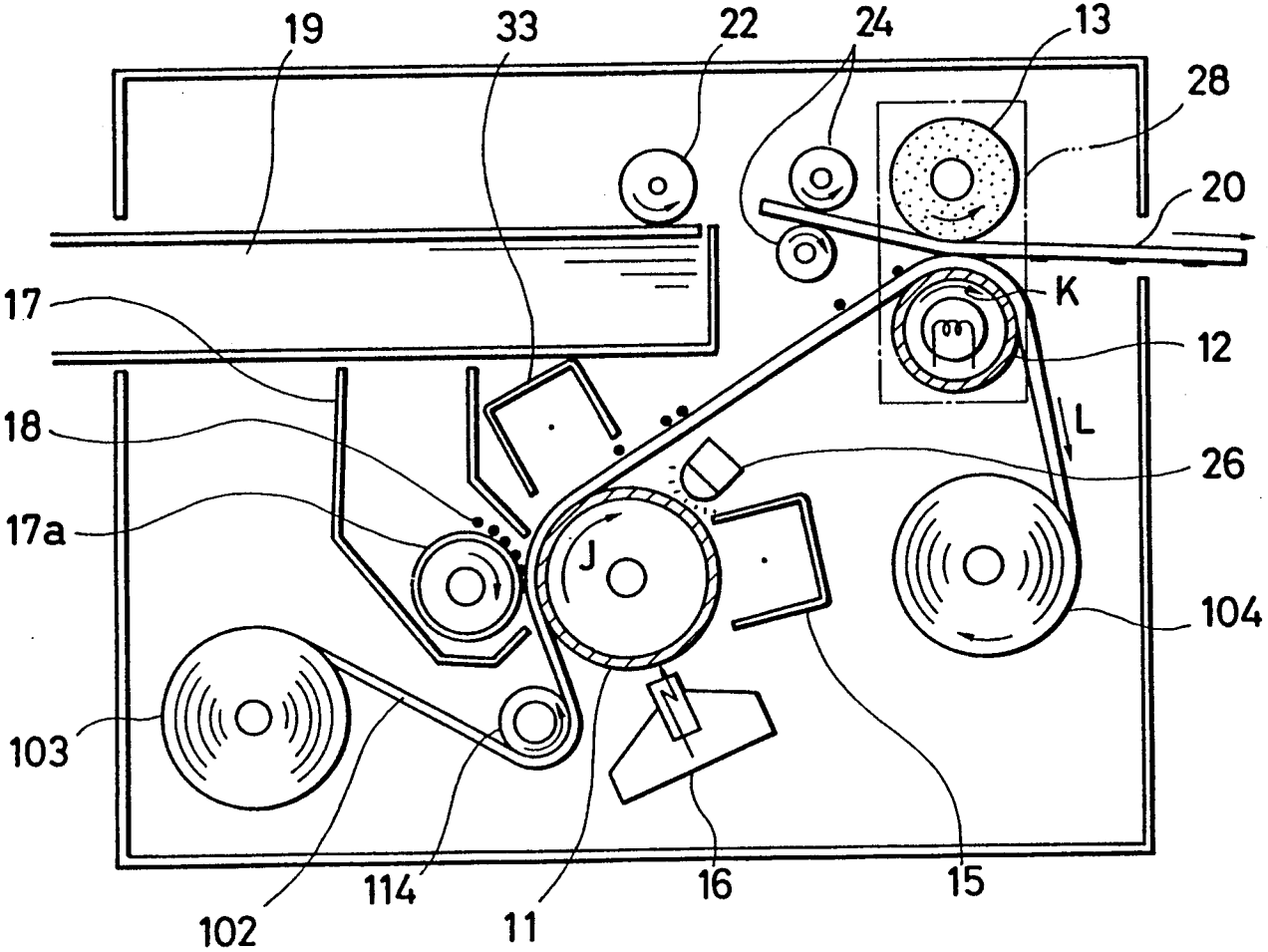
FIG. 5 is a schematic diagram showing the image forming system of another embodiment (Embodiment 2) of the invention.

In FIG. 5, reference numerals identical to those in FIG. 1 denote identical or similar devices or elements so their description is omitted.

Embodiment 2 differs from Embodiment 1, in that a two-ended toner image bearing belt 102 (having ends in the feed direction) is used in place of the endless toner image bearing belt 14 in Embodiment 1.

The exposure device 16 of this embodiment is disposed to face the photosensitive drum 11 directly, i.e., without interposition of the toner image bearing belt 102.

The toner image bearing belt 102 is supplied from a supply roller 103, is passed around a free roller 114, around the photosensitive drum 11, and around the heating roller 12, in the direction shown by the arrow L, and is then wound on a take-up roller 104.

A controller similar to the controller 30 in FIG. 1 is provided but it is omitted from illustration.

The operation of the electrophotography apparatus having the above construction will now be described.

The photosensitive drum 11 and the heating roller 12 are rotated at a constant peripheral speed in the direction shown by the arrows J and K by a drive means not shown. Moreover, a tension mechanism, not shown, applies a suitable tension via the free roller 114 to the toner image bearing belt 102. As a result, due to friction between the toner image bearing belt 102 and the photosensitive drum 11 and the contact pressure between the heating roller 12 and the pressure roller 13, the toner image bearing belt 102 moves in the direction L at the same speed as the peripheral speed of the photosensitive drum 11 and the heating roller 12.

The operations at the charging section, the exposure section, the developing section, and the transfer and fixing section are identical to those described with reference to FIG. 2A to FIG. 2E, and the heating of the toner image bearing belt 102 is made directly, i.e., not through the recording paper 20.

After developing, toner image bearing belt 102 carrying the toner image separates from the photosensitive drum 11, and the discharging device 33 removes the surface charges from the toner image bearing belt 102. This suppresses the rise in the potential difference due to the decrease in the capacitance of the air layer between the toner image bearing belt 102 and the photosensitive drum 11 where they are separating, and prevents discharge through the air layer. Disturbance of the toner image on toner image bearing belt 102 at the time of separation is thus prevented.

After the transfer and fixing, the recording paper 20 is then ejected outside the image forming system, with the toner image facing down, and stacked by a stacker not shown in the figure.

After the transfer of the toner image to the recording paper 20, a small amount of toner may remain on the toner image bearing belt 102, and the toner image bearing belt 102 is recovered by the take-up roller 104 with this residual toner still adhering to it. The residual toner recovered by the take-up roller 104 however has been melted in the transfer and fixing process, and fixed on the toner image bearing belt. There is therefore no scattering of toner inside or outside the device, or over the operator.

EMBODIMENT 3

A third embodiment (Embodiment 3) is an image forming system using a thermosensitive medium in combination with a photosensitive member. More specifically, the image forming system of this embodiment is featured by the combination of use of a reversible thermosensitive medium for conversion of electrical signals into a transmittance image on the thermosensitive, and use of a photosensitive member for conversion of the transmittance image into an electrostatic image on the photosensitive member.

The reversible thermosensitive medium used in this embodiment consists of a substrate coated with a thermochromic material. Recording on a thermochromic material can be made by utilizing its capacity to change transmittance depending on temperature variation.

Figure 6:
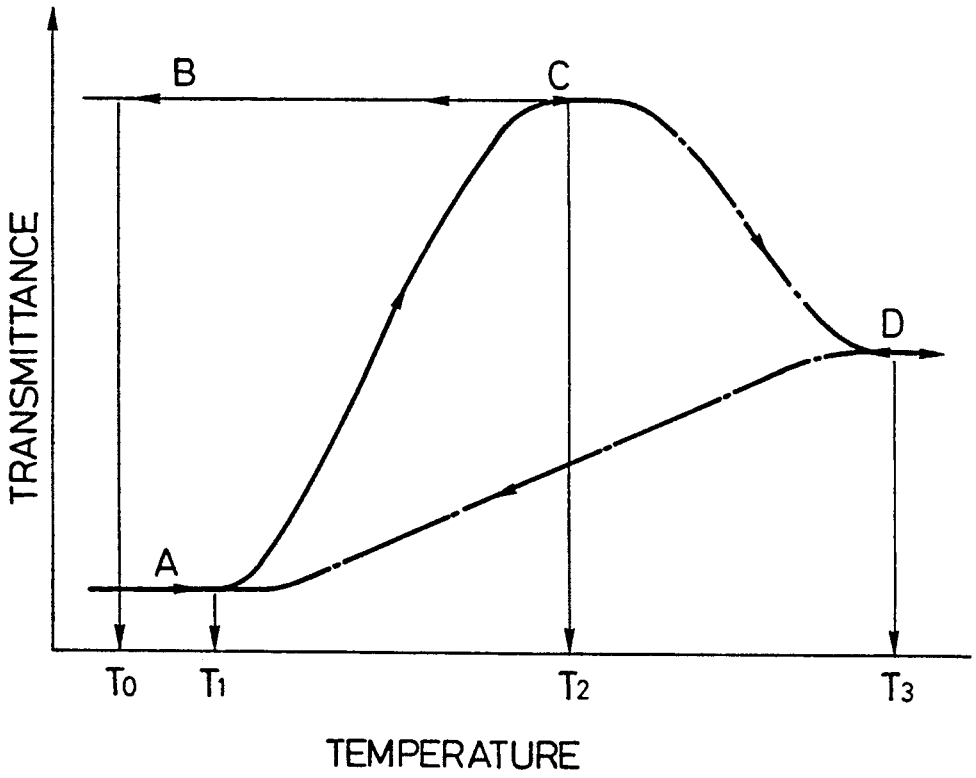
FIG. 6 a diagram showing the relationship between temperature and transmittance for a reversible thermosensitive medium.

FIG. 6 a diagram showing the relationship between temperature and transmittance for a reversible thermosensitive medium.

The thermosensitive medium is characterized by the fact that its state can be altered between a transparent state and a nontransparent state, and the transmittance at room temperature varies depending on the temperature to which the medium has been last heated. Assume that this thermosensitive medium is first in the nontransparent state A at room temperature T0. When the thermosensitive medium is heated, the transmittance begins to increase at temperature T1, and reaches its maximum to assume state C at a temperature T2. When the thermosensitive medium is then cooled to room temperature, it follows along the solid line and reaches the state B where it maintains the transparent state B.

If the reversible thermosensitive medium is heated to a temperature above T3, it reaches an intermediate state between transparent state B and nontransparent state A. If the thermosensitive medium is then cooled to room temperature T0, it follows along the chain line, and reaches the original nontransparent state A.

Let image-writing begin at state A. The areas of the thermosensitive medium on which pixels of one color (e.g., black) of the image are to be formed are heated to the temperature T2. When the thermosensitive medium returns to room temperature, the areas heated to T2 assume the state B, and a difference of transmittance is thus produced between the heated areas and the nonheated areas. Further, if the thermosensitive medium is heated to a temperature at or above T3, it can be returned to the original nontransparent state A.

Figure 7:
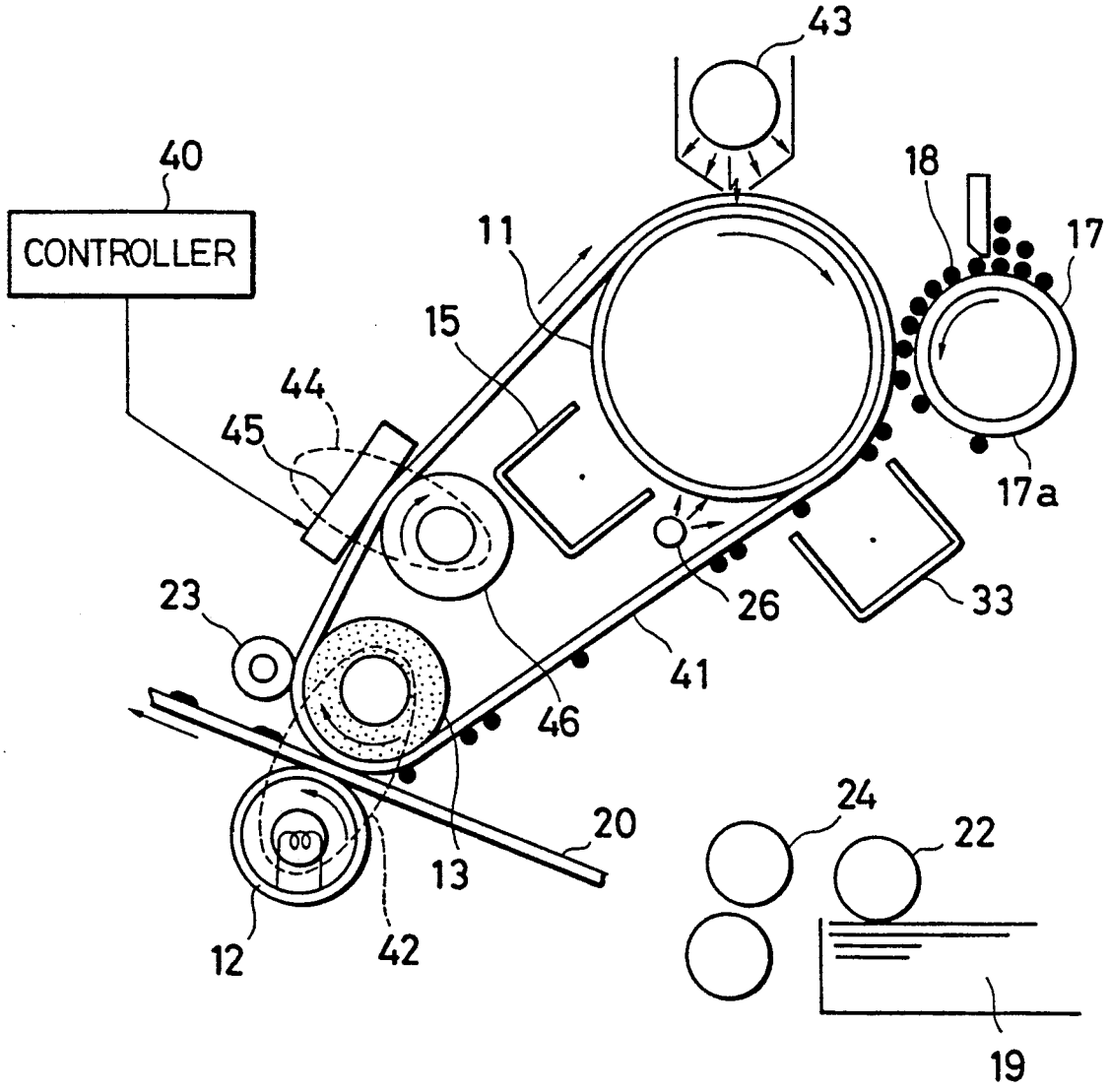
FIG. 7 is a schematic diagram showing the image forming system of yet another embodiment (Embodiment 3) of the invention.

FIG. 7 schematically illustrates the arrangement of the image forming system of Embodiment 3. The reference numerals as in FIG. 1 or FIG. 5 denote identical or corresponding members, so their description is omitted.

The photosensitive drum 11 has a photosensitive layer on an electrically conducting support. Suitable materials for the photosensitive layer are selenium photosensitive material, and an organic photosensitive material.

A toner image bearing belt 41 of this embodiment comprises a thermosensitive belt.

The location where the heating roller 12 confronts the pressure roller 13 forms an integrated transfer-fixing-erasure section (TFE section) 42. This TFE section the functions of transfer and fixing of the toner image as described in connection with Embodiment 1, and the function of erasing the transmittance image from the thermosensitive belt 41, as will later be described in further detail.

As the photosensitive drum 11 rotates, its surface sequentially passes the charging device 15, a whole-surface exposure device 43, the developing device 17, the discharging device 33, and the discharge lamp 26.

Before being brought into contact with the photosensitive drum 11, the thermosensitive belt 41 passes through a thermal writing section 44, which comprises a thermal head 45, constituting a heat-emitting recording element, and a platen roller 46. The thermosensitive belt 41 is held between the thermal head 45 and the platen roller 46. After being separated from the photosensitive drum 11, the thermosensitive belt 41 passes the TFE section 28, and the cleaning device 23.

The thermal head 45 comprises a row of heat-emitting elements which are disposed to produce pixels of a transmittance image on the thermosensitive belt 41, and are driven selectively in accordance with electrical signals representing the image to be formed. When the heat-emitting elements are driven, they heat the areas for the corresponding pixels to the temperature T2. When the heat-emitting elements not driven, the areas corresponding to the respective pixels are kept below T1.

The electrical signals representing the image are supplied from a controller 40 which also performs the overall control of the apparatus.

The areas or dots of the thermosensitive belt 41 that have been heated to the temperature T2 have a high transmittance, while the areas or dots of the thermosensitive belt 41 that are kept below T1 have a low transmittance. This does not mean that each area can assume either of the two distinct states: a transparent state or a nontransparent state with a certain fixed transmittance. That is, there can be intermediate states and the transmittance of each area is dependent on the density of the corresponding area of the image. However, the following description will be made assuming that the image consists of the two states, for simplicity of explanation and illustration.

The exposure device 43 performs the whole-surface exposure. It exposes the photosensitive drum 11 through the thermosensitive belt 41, while the transmittance image on the thermosensitive belt 41 is still maintained either because of the hysteresis characteristics or because the erasure takes place before the heated parts of the thermosensitive medium have not cooled substantially.

The exposure device 43 is a light source, such as a neon lamp, a halogen lamp, a row of LEDs (light-emitting diodes), for illuminating the thermosensitive belt 41 with a uniform intensity over the entire width of the thermosensitive belt 41. Because the transmittance of the thermosensitive belt 41 has been modulated according to the image the amount of light reaching the surface of the photosensitive drum 11 is modulated and hence an electrostatic latent image is formed on the photosensitive surface of the photosensitive drum 11. The areas or dots of the photosensitive surface which have been irradiated by light are discharged, while the areas or dots of the photosensitive drum which have not been irradiated are kept charged.

The TFE section 28 applies heat and pressure on the thermosensitive belt 41 and the recording paper 20 which is supplied to perform the transfer of the toner image onto the recording paper 20, the fixing of the toner image on the recording paper 20, and the erasure of the transmittance image on the thermosensitive belt 41.

The discharging device 33 is disposed to face the thermosensitive belt 41 passing over the photosensitive drum 11 at the location where the thermosensitive belt 41 separates from the photosensitive drum 11.

As described earlier, after passing through the TFE section 28, the thermosensitive belt 41 also passes the cleaning device 23.

The image forming process will now be described with reference to FIG. 8A to FIG. 8E.

Figure 8A:
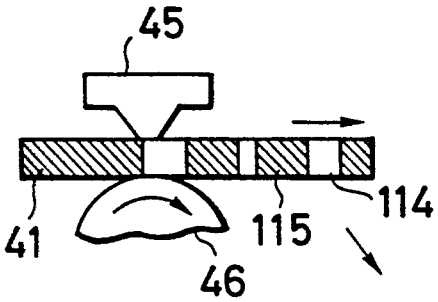
FIG. 8A to FIG. 8E show various process steps of the operation of the image forming system of Embodiment 3.
Figure 8B:
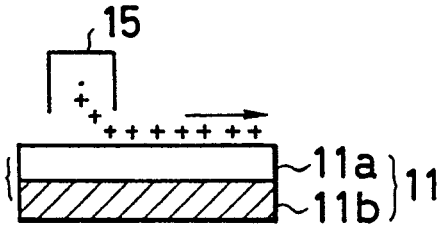
Figure 8C:
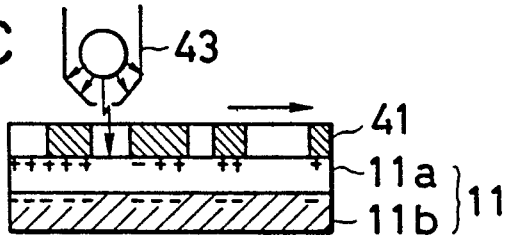
Figure 8D:
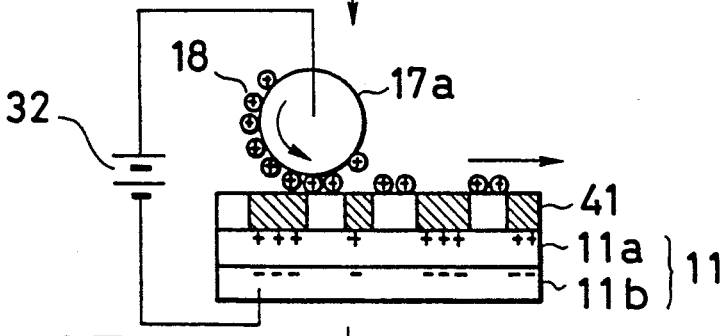
Figure 8E:
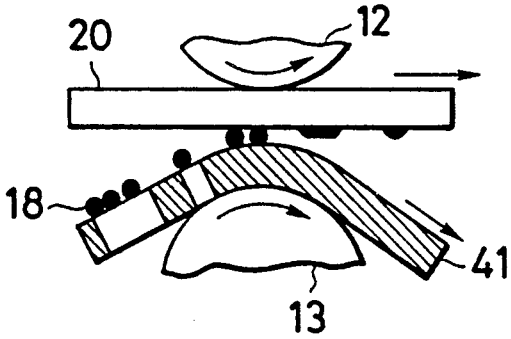

FIG. 8A shows the thermal writing step, FIG. 8B shows the charging step, FIG. 8C shows the whole-surface exposure step, FIG. 8D shows the development step, and FIG. 8E shows the transfer and fixing step.

As illustrated, when the photosensitive drum 11, the pressure roller 13, the heating roller 12 and the platen roller 46 are rotated in the direction shown indicated by arrows at a constant circumferential speed by a drive means, not shown in the figure, the thermosensitive belt 41 moves in the direction indicated by an arrow due to friction with the photosensitive drum 11, the pressure roller 13, the heating roller 12 and the platen roller 46.

The thermosensitive belt 41 is initially at the nontransparent state A (FIG. 6). In the thermal writing step shown in FIG. 8A, a transmittance image is written on the thermosensitive belt 41 by selective heating in accordance with electrical image signals. The resultant transmittance image has transmittances for the respective pixels corresponding to the electrical image signals. The areas or dots 114 heated to a high temperature to have become transparent are shown unhatched in FIG. 8A, whereas the areas or dots 115 that have not been heated and remain nontransparent are shown hatched in FIG. 8A.

In the charging step shown in FIG. 8B, the surface of the photosensitive drum 11 is directly charged uniformly by the corona discharge device 15.

In the exposure process shown in FIG. 8C, light from the exposure device 16 passes through the thermosensitive belt 41 and is irradiated onto the photosensitive drum 11 to form an electrostatic latent image on the photosensitive layer 11*a* of the photosensitive drum 11. The amount of light irradiating each area or dot of the photosensitive layer 11*a* of the photosensitive drum 11 corresponds to the transmittance of the corresponding area or dot of the transmittance image of the thermosensitive belt 41.

In the developing step shown in FIG. 8D, reversal development is used, and the power supply 32 is connected across the electrically conducting support 11*b* of the photosensitive drum 11 and the toner support 17*a* to apply the bias potential. As a result, the discharged areas of the latent image on the photosensitive drum 11 attract the positively charged toner 18, and the attracted toner 18 is attached to the outer surface of the thermosensitive belt 41 directly over the discharged areas.

As the thermosensitive belt 41 separates from the photosensitive drum 11, the discharging device 33 removes the surface charges from the thermosensitive belt 41.

Finally, the toner image on the thermosensitive belt 41 is moved past the TFE section 28, where the toner image on the thermosensitive belt 41 is transferred to and fixed on the recording paper 20. During the transfer and fixing, the thermosensitive belt 41 is heated to a temperature above T3 so that it reaches the state D and then resumes the original state A when it cools, having passed the TFE section 42. In this way, all the pixels along the entire width of the thermosensitive belt 41 will resume the original nontransparent state A ready for the next cycle operations.

EMBODIMENT 4

Figure 9:
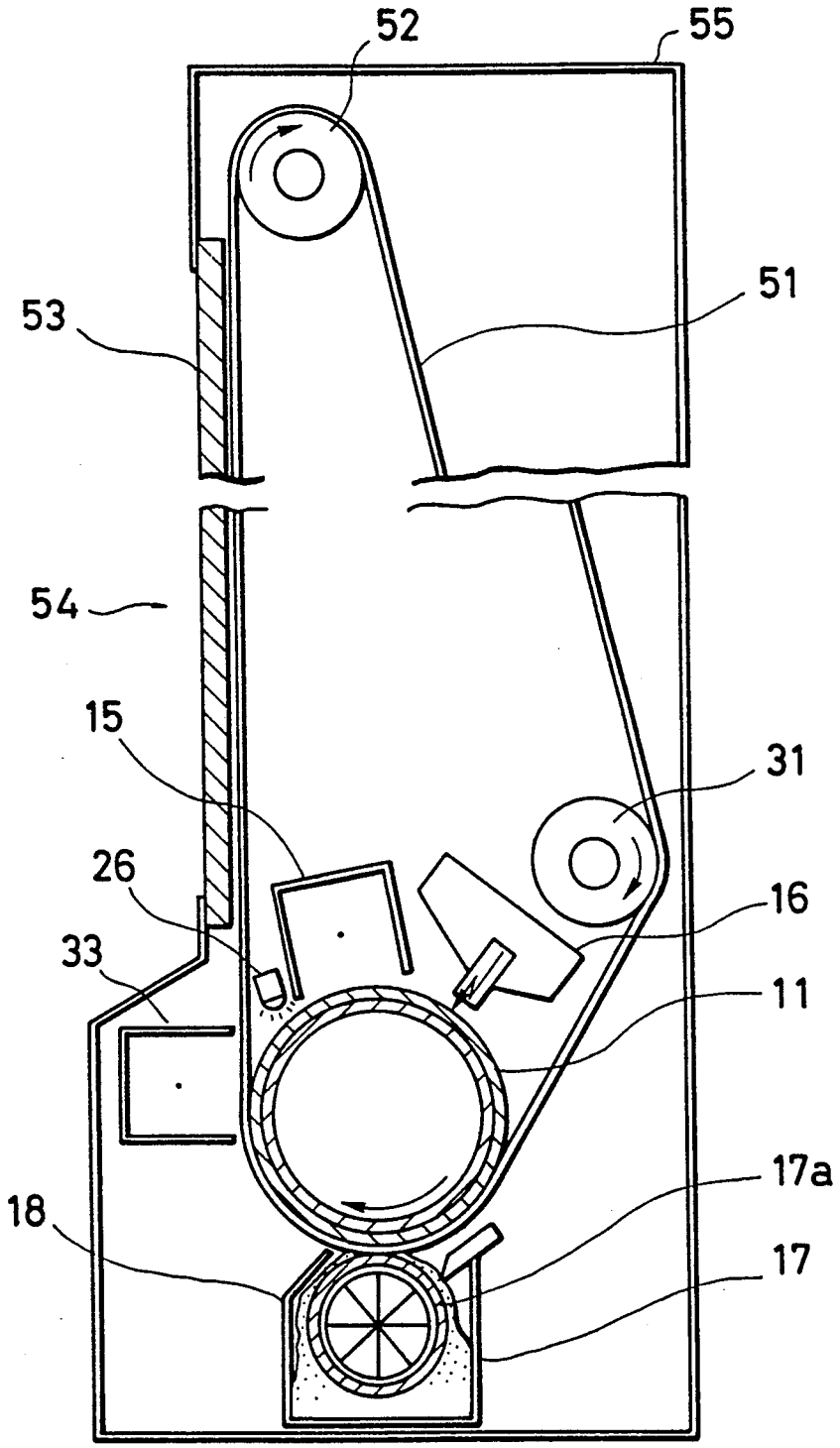
FIG. 9 is a schematic diagram showing the image forming system of a further embodiment (Embodiment 4) of the invention.

FIG. 9 shows an image forming system of a fourth embodiment (Embodiment 4) of this invention. This image forming system is a display device for permitting the toner image to be seen from outside the apparatus. Reference numerals identical to the previous figures denote identical or corresponding members, and their description is omitted.

As illustrated, an endless toner image bearing belt 51 of this embodiment serves as a display medium. This toner image bearing belt 51 is stretched between the photosensitive drum 11, a free roller 52 and a tension roller 31. The free roller 52 and the photosensitive drum 11 are spaced over a distance and the toner image bearing belt 51 stretched between them form a flat region facing outward through a transparent glass plate 53. The glass plate 53 and the flat portion of the toner image bearing belt 51 form a display section 54 which permits the toner image to be seen from outside of the housing 55 of the apparatus. To facilitate observation of the toner image by reflection, the base material of the toner image bearing belt 51 is white in color, e.g., by being coated with white paint. The toner image then stands out with good contrast against a white background. As an alternative to the white toner image bearing belt 51, a transparent toner image bearing belt in combination with a white reflector on the back, or with a back-light (planar light source emitting diffused light and illuminating the belt from the back, like one being provided in a back-lighted liquid crystal display) may be used.

As the photosensitive drum 11 rotates, the toner image bearing belt 51 moves passing the photosensitive drum 11, the display section 54, the free roller 52 and the tension roller 31.

When the toner image bearing belt 51 passes the developing device 17, a toner image corresponding to the electrostatic latent image having been formed on the photosensitive drum 11 is formed.

As the toner image bearing belt 51 having a toner image formed thereon separates from the photosensitive drum 11, the surface charges are removed by the discharging device 33.

The toner image bearing belt 51 then moves on to the display section 54. At this display section 54, the toner image formed on the toner image bearing belt 51 can be observed through the glass plate 53.

In one mode of display, the toner image bearing belt 51 is stopped when a frame of image or some other distinct unit of image has been formed, and does not move again until commanded by manual input. When it is commanded to change the display, the toner image bearing belt 51 is moved on again. When the toner image bearing belt 51 reaches the developing device 17, the previous toner image is removed and a new toner image is formed.

In another mode of display, the toner image bearing belt 51 is kept moving so that the contents of the display keeps moving (scrolling), either at a constant speed or intermittently, in one direction (upward in the illustrated embodiment). As in the first-mentioned display mode, the old toner image on the toner image bearing belt 51 is removed when a new toner image is formed at the developing device 17.

The toner image bearing belt 51 used here must have some degree of insulating properties and mechanical strength, and polyester film is therefore used as the base material. Further, in view of the electric lines of force generated between the toner image bearing belt 51 and the toner support 17*a* during developing, it is desirable that the thickness of the belt 51 is no more than 100 μm, while in view of the need for tensile strength and ease of handling, it should not be less than 5 μm.

EMBODIMENT 5

Figure 10:
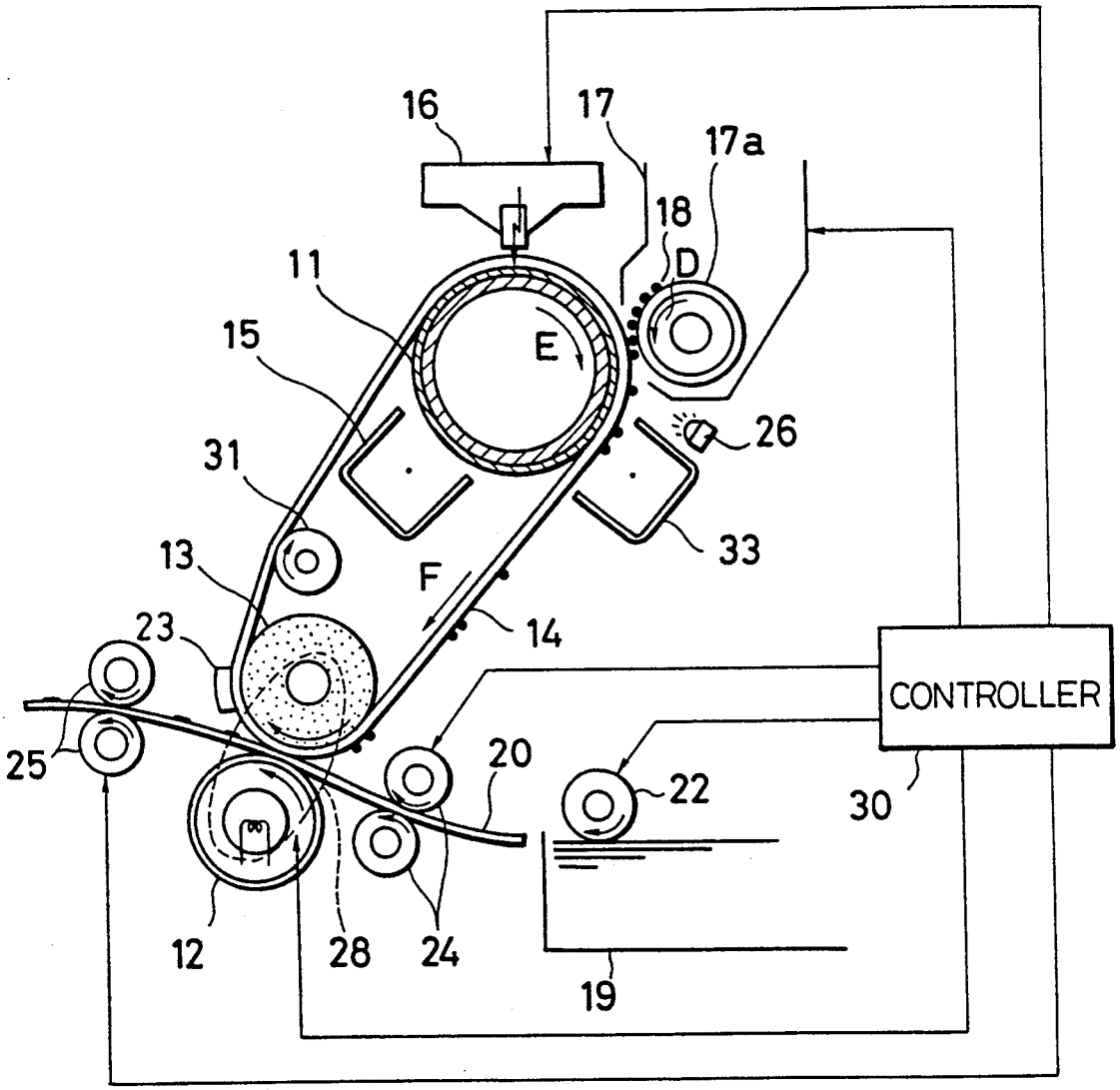
FIG. 10 is a schematic diagram showing the image forming system of a still further embodiment (Embodiment 5) of the invention.

A fifth embodiment (Embodiment 5) is illustrated in FIG. 10. Reference numerals identical to those in FIG. 1 denote identical or similar members and their description is omitted.

Embodiment 5 is similar to Embodiment 1, but the position of the discharge lamp 26 is changed. That is, the discharge lamp 26 is disposed to irradiate the photosensitive drum 11 through the toner image bearing belt 14, between location where the developing device 17 is disposed and the location where the discharging device 33 is disposed. The toner image bearing belt 14 is transparent to the wavelengths of light from the discharge lamp 26, as well as to the wavelengths of light from the exposure device 16. It is advantageous that the discharge lamp 26 emits light whose wavelength component substantially overlap substantially with the wavelength component of the exposure device 16, so that the toner image bearing belt 14 which is transparent to the light from the exposure device 15 is also transparent to the light from the discharge lamp 26. The transparency of the toner image bearing belt 14 to the light from the discharge lamp 26 may however be partial. This is because the intensity of the discharge lamp 26 may be increased to be sufficient for the desired function of the discharge. This is in contrast to the light intensity of the exposure device 15 which should not be excessive and should be optimized to produce electrostatic latent image consisting of charged and discharged areas.

The discharging device 33 in this embodiment is an AC corona charger.

The disposition of the discharge lamp 26 upstream of the corona charger 33 is considered advantageous for the reason which will be discussed below.

In the image forming system of Embodiment 1, a discharging device is provided to remove the surface charges from the toner image bearing belt before or at the time of the separation thereof from the photosensitive drum. It has however been found that with the system of Embodiment 1, background noise of the image on the recording paper 20 increases progressively with increased use of the apparatus.

This is because the charging potential above toner image bearing belt 14 superimposed on the photosensitive drum 11 gradually decreases. The variation of charging potential is due to the fact that charges are transferred to the toner image bearing belt 14 when it separates from the photosensitive drum 11.

Figure 11:
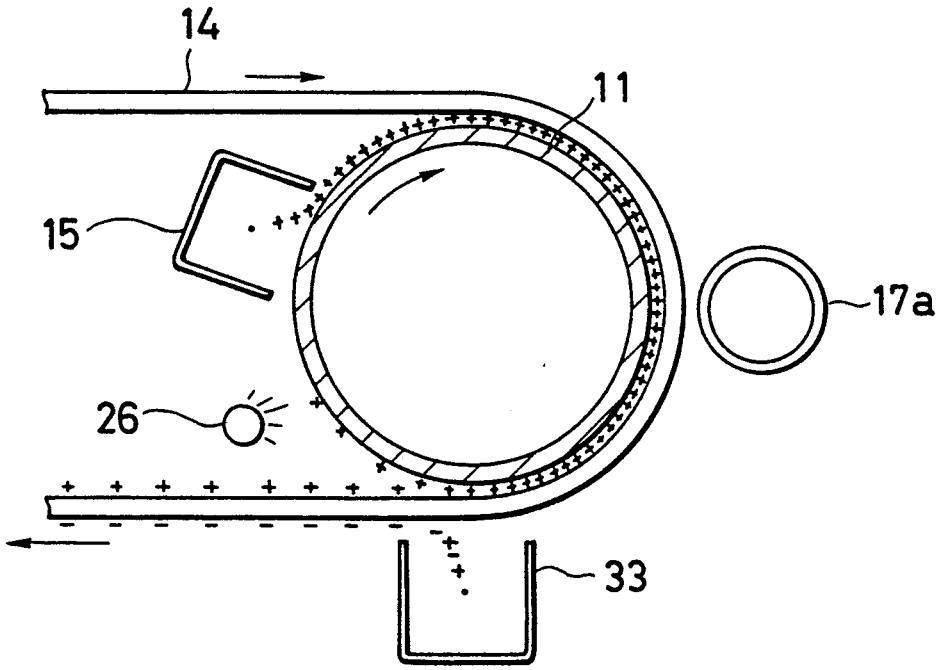
FIG. 11 is an enlarged partial view showing the toner image bearing belt separating from the photosensitive drum in the image forming system of Embodiment 1.

FIG. 11 is an enlarged partial view showing the part of the toner image bearing belt 14 which separates from the photosensitive drum 11 in the image forming system of Embodiment 1.

When the charging potential on the charged areas on the toner image bearing belt 14 superimposed on the photosensitive drum 11 was measured, it was found to decrease gradually as image forming operation of the system was repeated. When the operation of the apparatus was stopped, the charges on the photosensitive drum 11 was removed by irradiation with light, and the potential on the toner image bearing belt 14 superimposed on the photosensitive drum 11 was measured, it was found to be have a polarity opposite to the polarity of the potential on the photosensitive drum 11. As the charging polarity of the photosensitive drum 11 in the above image forming system of Embodiment 1 was positive, a negative potential was detected on the toner image bearing belt 14.

This is due to the fact that, as shown in the figure, the toner image bearing belt 14 becomes charged in the area which is separating from the photosensitive drum 11. If image forming is continued in this condition, even if the photosensitive drum 11 is uniformly charged, the toner image bearing belt 14 becomes charged, and the potential on the toner image bearing belt 14 superimposed on the photosensitive drum 11 effectively decreases. If the toner image bearing belt 14 is developed in this condition, increased background noise occurs in the uncharged areas.

To investigate the reason why the toner image bearing belt 14 was charged, a comparison was first made with the AC corona charger 33 ON and OFF. When the charger 15 was switched ON and the charging potential on the toner image bearing belt 14 superimposed on the photosensitive drum 11 was measured, it was found that the charging potential was stable over a long period of time when the AC corona discharger 33 is OFF, but decreases when the AC corona discharger 33 was ON. It is thus evident that the AC corona discharger 33 is responsible for the decline of charging potential.

A further comparison was made with the AC corona discharger 33 ON, and the discharge lamp 26 ON or OFF. It was found that the charging potential decreased sharply when discharge lamp 119 was OFF, but that there was less decrease when it was ON. This is due to the fact that when the discharge lamp 26 is ON, the light from the lamp 26 irradiates the whole of the separating area, thereby removing some of the charges on the surface of the photosensitive drum 11 so that it has less charge. It may thus be conjectured that the decrease of charging potential is related to the fact that charges are present on the photosensitive drum 11 before it reaches the separation area.

In the image forming system of Embodiment 1, therefore, charges on the photosensitive drum 11 move onto the toner image bearing belt 14 due to the AC corona discharger 33 installed at the position where the photosensitive drum 11 leaves the toner image bearing belt 14, and as a result of the charging of the toner image bearing belt 14, the charging potential on the toner image bearing belt 14 superimposed on the photosensitive drum 11 declines.

The AC corona discharger 33 was installed to prevent scattering of the toner image formed on the toner image bearing belt 14 in the separating area. To further prevent charging of the toner image bearing belt 14 when the AC corona discharger 33 is ON, therefore, it is evident that a discharge lamp or some other optical discharge means for irradiating the photosensitive drum through the toner image bearing belt should be installed in the separation area or upstream of it to remove charges from the photosensitive drum 11 when or before it reaches this separation area.

The improvement of this Embodiment 5 was conceived to overcome the above problems. It aims to provide a means of preventing charging after the toner image bearing belt superimposed on the photosensitive drum carrying the electrostatic latent image has been subjected to development, and when or before the toner image bearing belt separates from the photosensitive drum. It thus aims to provide an image forming system which gives stable recordings over a long period of time.

In the image forming system of Embodiment 5, the discharging device comprises an AC corona discharger and an optical discharge means, such as a discharge lamp, is arranged in opposition to the toner image bearing belt between the AC corona discharger and the developing device, as described above.

Before the AC corona discharger removes surface charges from the toner image bearing belt, the optical discharge means causes the charges on the photosensitive drum disappear, and charging of the toner image bearing belt due to the AC corona discharger which otherwise occurs when the toner image bearing belt separates from the photosensitive drum is thereby prevented.

Figure 12:
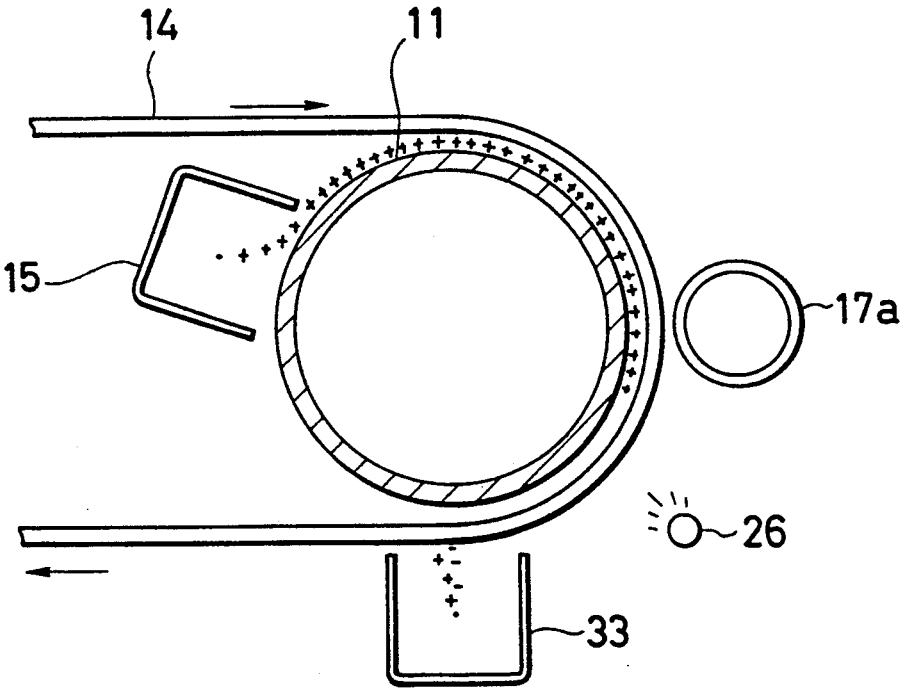
FIG. 12 is an enlarged partial view showing of the part of the toner image bearing belt separating from the photosensitive drum in the image forming system of Embodiment 5.

FIG. 12 is an enlarged partial view showing of the toner image bearing belt which separates from the photosensitive drum in the image forming system of Embodiment 5.

As illustrated, the discharge lamp 26 used as an optical discharge device is disposed between the developing device 17 and the AC corona discharger 33 to irradiate the photosensitive drum 11 through the toner image bearing belt 14.

With the arrangement described above, the charging potential was found to remain constant for a long period even though AC corona discharger 33 is ON. This is due to the fact that charges on the photosensitive drum 11 are removed by the discharge lamp 26 before they reach the separation area, as shown in the figure, and are therefore not transferred to the toner image bearing belt 14 by the AC corona discharger 33 which is installed in the separation area.

The operation of the image forming system of Embodiment 5 for the various processes will be described with reference to FIG. 13A to FIG. 13F.

Figure 13A:
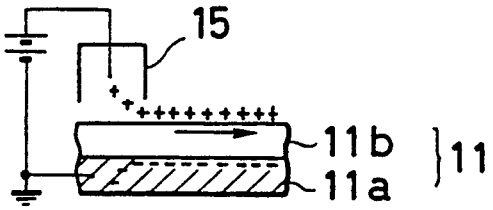
FIG. 13A to FIG. 13F show various process steps of the operation of the image forming system of Embodiment 5.
Figure 13B:
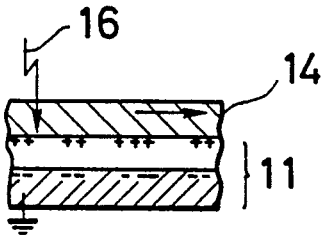
Figure 13C:
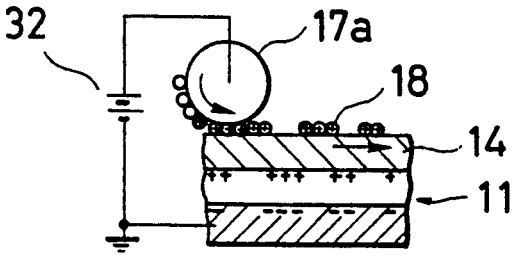
Figure 13D:
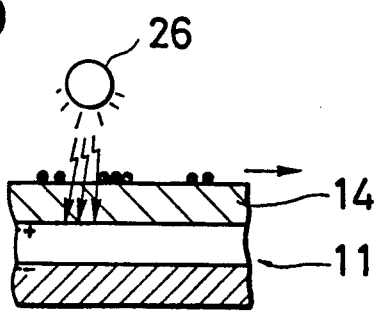
Figure 13E:
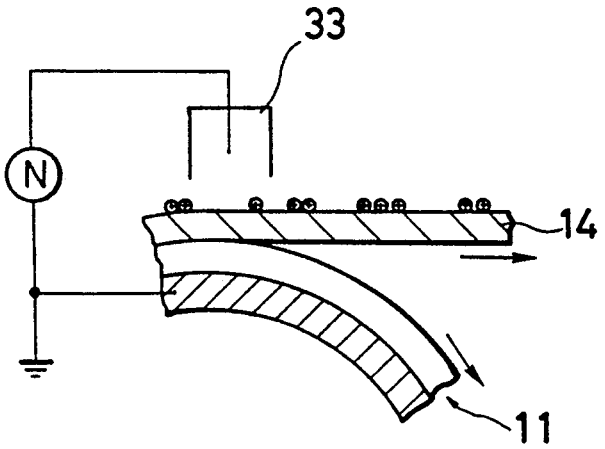
Figure 13F:
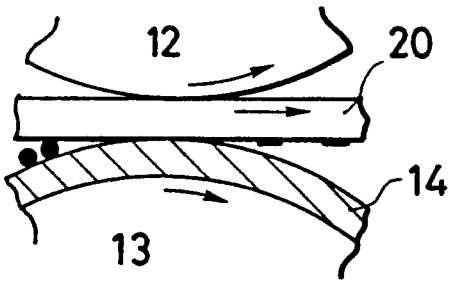

FIG. 13A shows the charging process, FIG. 13B shows the exposure process, FIG. 13C shows the developing process, FIG. 13D shows the optical discharge process, FIG. 13E shows the separation process, and FIG. 13F shows the transfer and fixing process.

When the photosensitive drum 11 is rotated, the toner image bearing belt 14 moves.

The charging device 15 uniformly charges the photosensitive drum 11 (FIG. 13A).

In the exposure process, an electrostatic latent image corresponding to image signals is formed on the photosensitive drum 11 (FIG. 13B).

In the developing process, a toner image corresponding to the electrostatic latent image is formed on the toner image bearing belt 14 (FIG. 13C).

When the toner image bearing belt 14 on which a toner image has been formed passes the discharge lamp 26, light from the discharging lamp 26 passes through the toner image bearing belt 14 and reaches the photosensitive drum 11 and removes the charges from the surface of the photosensitive drum 11 (FIG. 11D). The light from the discharge lamp 26 is prevented from entering the developing area where the development is carried out. This is achieved by shielding, for example by means of the housing of the developing device 17.

When the toner image bearing belt 14 separates from the photosensitive drum 11, no charges remain on the photosensitive drum 11 (FIG. 13E). As no charges remain on the photosensitive drum 11, there is no transfer of charge from the photosensitive drum 11 to the toner image bearing belt 14, when the toner image bearing belt 14 is irradiated with positive and negative charges by the AC corona discharger 33 in the separation area.

Further, when the toner image bearing belt 14 separates from the photosensitive drum 11, its surface charges are removed by the AC corona discharger 33.

The toner image bearing belt 14 which has separated from the photosensitive drum 11 is then moved on to the transfer and fixing section 28, where the transfer and fixing is performed (FIG. 13F).

The improvement of Embodiment 5 can be also applied to Embodiment 2.

The embodiments described above are not to be considered exhaustive, and other variations within the spirit of the invention shall not be excluded from it.

For example, the image may also be transferred from the toner image bearing belt to the recording paper electrostatically. Further, instead of transferring the toner image formed on the toner image bearing belt to a recording paper, the image may be made to be seen from outside of the apparatus to serve as a display.

Instead of the photosensitive drum, any other member for carrying an electrostatic latent image may be used. Instead of the toner image bearing belt, any other form of medium for carrying a toner image may be used.

As have been described, according to this invention, a discharging means, such as an AC corona discharger, is provided to face the toner image bearing member superimposed on the electrostatic latent image bearing member, such as a photosensitive drum, at a location downstream of the developing area, so that the surface charges on the toner image bearing member is removed before or when the toner image bearing member separates from the photosensitive drum. As a result, the increase of the potential difference across the air layer due to the decrease of the capacitance of the air layer between the toner image bearing member and the photosensitive drum is prevented, and electrical discharge through the air layer, and attendant scattering of the toner image are thereby avoided.

Moreover, when the optical discharge device is disposed upstream of the AC corona discharger to irradiate the photosensitive drum through the toner image bearing member, the photosensitive drum is discharged before the toner image bearing member passes the AC corona discharger. As a result, there will be no transfer of charges from the photosensitive drum to the toner image bearing member at the time when they pass the AC corona discharger, so there will be no accumulation of charges on the toner image bearing member as the image forming operation is repeated. The increased background noise in the resultant images are therefore avoided.

What is claimed is:

1. An image forming system comprising:

an electrostatic latent image bearing member on which an electrostatic latent image is formed;

a toner image bearing member which is brought into contact with said electrostatic latent image bearing member to be superimposed therewith;

developing means for developing said electrostatic latent image to form a corresponding toner image on said toner image bearing member while said toner image bearing member is superimposed with said electrostatic latent image bearing member; and discharging means provided opposite said toner image bearing member superimposed on said electrostatic latent image bearing member, and downstream of said developing means, for removing surface charges from said toner image bearing member before it separates from said electrostatic bearing member.

2. An image forming system as set forth in claim 1, wherein said discharging means is a corona discharger.

3. An image forming system as set forth in claim 2, wherein said corona discharger is an AC corona discharger.

4. An image forming system as set forth in claim 3, further comprising:

an optical discharging means disposed between said corona discharger and said developing means to irradiate said electrostatic latent image bearing member through said toner image bearing member;

wherein said toner image bearing member is at least partially transparent to the light from said optical discharging means.

5. An image forming system as set forth in claim 3, wherein said corona discharger is disposed at the location where the toner image bearing member separates from the electrostatic latent image bearing member.

6. An image forming system as set forth in claim 1, further comprising:

an exposure device for exposing the electrostatic latent image bearing member to a light image through said toner image bearing member;

an optical discharging means disposed between said discharging means and said developing means to irradiate said electrostatic latent image bearing member through said toner image bearing member;

wherein said discharging means is a corona discharger; and said toner image bearing member is at least partially transparent to the light from said optical discharging means and to the light from said exposure device.

7. Apparatus according to claim 6, wherein said exposure device is provided to face the photosensitive member without interposition of the toner image bearing belt.

8. An image forming system as set forth in claim 1, further comprising:

thermal writing means; and charging means;

wherein said electrostatic latent image bearing member has a surface moving to pass by said charging means and said exposure means;

said charging means uniformly charging the surface of said photosensitive member as it passes by said charging means;

said toner image bearing member is a reversible thermosensitive medium which passes by said thermal writing means and then said exposure means;

said thermal writing means selectively applying heat to said thermosensitive medium to form a transmittance image represented by different transmittances; and said exposure means exposing the uniformly charged photosensitive member through said thermosensitive medium on which said transmittance image has been formed, to form an electrostatic image on said photosensitive member, said electrostatic image corresponding to said transmittance image.

9. An image forming system according to claim 1, further comprising a display section permitting said toner image on said toner image bearing member to be seen from outside of the system.

10. An image forming system according to claim 1, wherein said electrostatic latent image bearing member is a photosensitive drum and said toner image bearing member is a belt.

11. An image forming system according to claim 1, wherein said discharging means is disposed opposite said toner image bearing member substantially at the location where said toner image bearing member belt separates from said electrostatic latent image bearing member.

* * * * *